United States Patent [19]

Kallfass

[11] Patent Number: 4,597,193

[45] Date of Patent: Jul. 1, 1986

[54] SHRINKING TUNNEL

[75] Inventor: Karl-Heinz Kallfass, Nürtingen, Fed. Rep. of Germany

[73] Assignee: Kallfass Verpackungsmaschinen GmbH, Fed. Rep. of Germany

[21] Appl. No.: 655,926

[22] Filed: Sep. 28, 1984

[30] Foreign Application Priority Data

Oct. 1, 1983 [DE] Fed. Rep. of Germany ..... 3335790

[51] Int. Cl.[4] ..... F26B 9/06

[52] U.S. Cl. ..... 34/224; 34/225; 34/231

[58] Field of Search ..... 34/225, 233, 224, 231

[56] References Cited

U.S. PATENT DOCUMENTS

| | | | |
|---|---|---|---|
| 3,389,478 | 6/1968 | Cline . | |
| 3,430,358 | 3/1969 | Denker . | |
| 3,621,588 | 11/1971 | Grocke | 34/225 |
| 3,668,817 | 6/1972 | Bell | 34/225 |
| 3,777,446 | 12/1973 | Graver | 34/225 |
| 4,426,793 | 1/1984 | Kuboyama | 34/92 |

FOREIGN PATENT DOCUMENTS

| | | |
|---|---|---|
| 1511562 | 8/1969 | Fed. Rep. of Germany . |
| 1945047 | 9/1971 | Fed. Rep. of Germany . |

*Primary Examiner*—Larry I. Schwartz

[57] ABSTRACT

A shrinkage tunnel (11) for heat treatment of shrinkable films has a hot air unit, which can be inserted as a standard unit in a tunnel wall and contains a radial fan (22), which is surrounded by a fan casing (26) formed from two sheet metal half-shells (27, 28). Between them they form a ring nozzle (30) with an axial outflow direction with respect to fan shaft (25), while air return flow opening (32) is centrally and directly positioned below the fan wheel (22). The heating system is integrated into the fan casing, so that the complete hot air unit (20) is an independently functional and preassemblable component.

12 Claims, 2 Drawing Figures

SHRINKING TUNNEL

Figure 1:
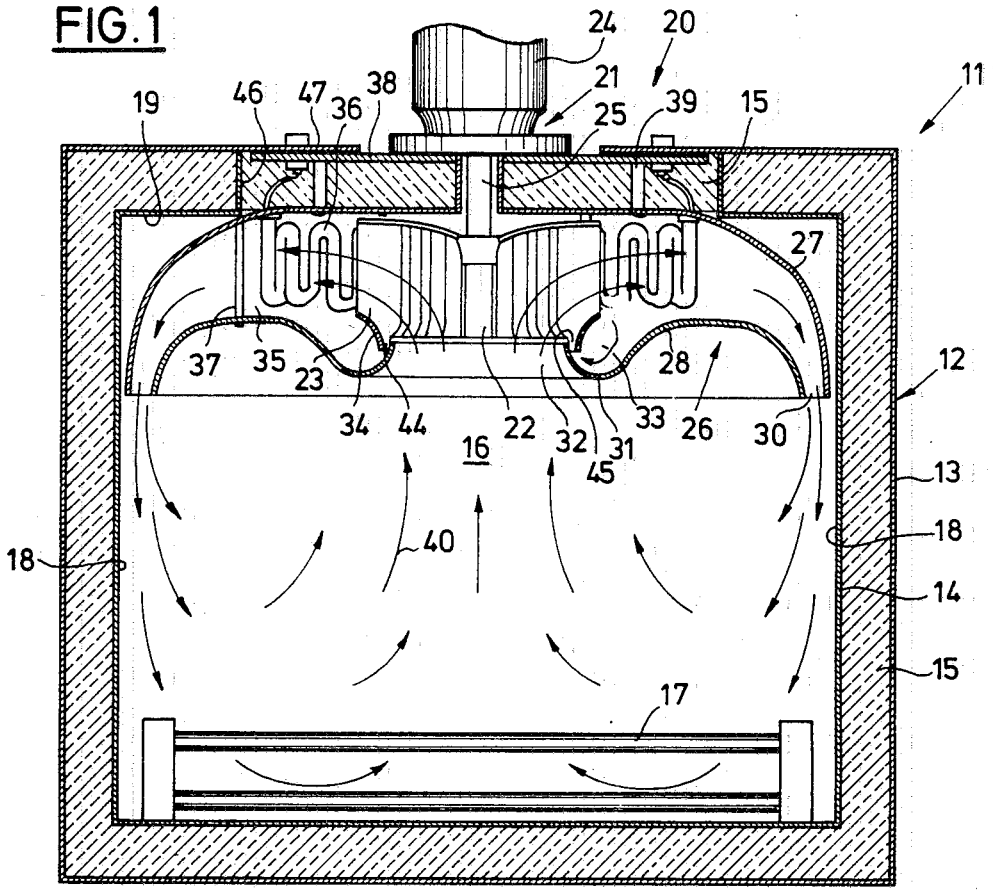

The present invention relates to a shrinkage tunnel according to the preamble of claim 1.

Whereas in the case of conventional shrinkage tunnels, the double wall thereof is used for air guidance or circulation purposes, in the Applicant's DOS No. 19 45 047 a bridge-like air duct is provided in the tunnel covering, through which extends a conveying means and which is peripherally provided with numerous adjustable openings through which the air enters. Air return takes place in the conveying direction at the front and rear following on to the bridge. Hot air is supplied by means of a fan located below the conveying means and having an unstream-connected heating area with U-shaped tubular heaters. Similar arrangement, also with overhead fans and air supply from the bottom only, or from the top and bottom by means of a plurality of slots are also known from U.S. Pat. Nos. 3,389,478 and 3,430,358. Such an arrangement is also described by DOS No. 15 11 562.

In all these arrangements, an attempt is made to guide the air by means of a maximum number of preferably adjustable inlets in such a way that the shrinkable film is shrunk as uniformly as possible and to the intended extent about the article to be packaged, preference being given to a guidance of the air so that it strikes the particular area of the article to be packaged in a vertical manner, so that the air flow action causes no displacement of the film during shrinkage on to the article.

Known shrinkage tunnels were very difficult to manufacture due to their complicated air ducts with possibly adjustable exit slots and, if necessary, had to be reset for each article to be packaged. As a result of the partial incorporation of the casing walls, considerable effort and expenditure had to be used in order to bring about satisfactory insulation, particularly as the hot air guidance in part also took up large areas outside the shrinkage tunnel. Furthermore, the large-area air ducts also increased the noise level.

The problem of the invention is to provide a shrinkage tunnel which, in the case of simplified air guidance or circulation, a satisfactory, uniform shrinkage action is ensured.

According to the invention this problem is solved by the characterizing part of claim 1. The arrangement with a large ring nozzle and a central return flow opening gives a basic flow with an apple-shaped or kidney-shaped configuration and this could also be defined as part of a torus. The air flows out of the ring nozzle with a relatively large exit cross-section, downwards in the marginal area and upwards again in the centre. It has surprisingly been found that despite this very clear and stable flow path, it is possible to heat articles to be shrunk in an extremely useful manner. This may be due to the distribution of the central return flow through the actual articles, but partly also as a result of the fact that each part of the article during its transfer through the closed air guidance system is conveyed twice through a vertically directed "soft", but uniform air curtain. Whereas hitherto return suction of the air took place in the end regions of the shrinkage tunnel, in the case of the invention this takes place in the centre of the ring nozzle. However, this decreases instead of increasing heat losses. This may be due to the action of the hot air curtain blocking air exchange at the start and finish. However, it has been found that an energy saving of approximately 30% can be obtained compared with conventional shrinkage tunnels of the same capacity.

Although the ring nozzle could also be square or rectangular, it is preferably circular and the return flow opening is positioned centrally therein, which gives ideal flow conditions.

According to a preferred embodiment, the ring nozzle is provided on the outer periphery of the exhaust conduit of the fan wheel constructed as a radial fan and preferably arranged within the shrinkage tunnel, whilst having an axial alignment with respect to the fan wheel, and the return flow opening is preferably the actual fan suction port. Thus, the fan is located within the shrinkage tunnel and the ring nozzle and return flow opening form parts of the exhaust conduit. The latter can contain heating means constructed as electrical tubular heaters and they are arranged around the fan wheel, preferably in the form of meander-like, zig-zag or wave-like arcuate or spiral sections. Furthermore, the casing parts forming the fan casing and defining the ring nozzle are preferably formed from two nested, shell-like sheet metal parts, where of the inner part contains the preferably flange-like or nozzle-shaped return flow opening. Apart from the casing parts belonging directly to the fan, namely the exhaust conduit and the central suction port, no other air ducts are required. In addition, the complete unit is arranged within the actual tunnel walls, so that the latter can be purely used for insulation purposes. This leads to considerable savings in manufacture and in particular energy savings in operation, because the mass to be heated is very small and no air guidance parts positioned outside the shrinkage tunnel have to be heated or insulated. Thus, heating to operating temperature can in part take place in a third of the hitherto required time. Through the omission of the long, large-area air ducts not only are the flow resistances low, but it is easily possible to damp the noise produced, i.e. the transfer of the noise of the fan to the air. The construction of the casing part from two simple sheet metal portions facilitates manufacture and ensures a good air circulation. Advantageously the ring nozzle has a large cross-section for low air speeds.

Preferably the fan with its casing containing the ring nozzle, return flow opening and the heating means and an optionally insulated base part, together with the fan motor arranged on the outside of said base part forms a standard component, the base part being insertable into an opening of the shrinkage tunnel wall preferably in order to close the same. This makes it unnecessary to mount any of the components required for ventilation and heating in a separate manner on the shrinkage tunnel and instead the complete hot air unit can be inserted therein as a preassembled component. It is then merely necessary to electrically connect it.

As in the case of a radial or centrifugal fan the outflowing air has a circumferential speed component, it is conventionally ensured in the case of such fans that this component is eliminated by a corresponding construction of the exhaust conduit, particularly with guide blades. Although it would be possible to arrange the guide blades in the heating or ring nozzle area, so that the ring nozzle would be subdivided into small succeeding individual chambers, preference is given to the construction in which the exhaust conduit is constructed without such guide blades. It has been found that the circumferential component of the flow improves the heat transfer between the hot air and the shrinkable film, without undesired turbulence occurring.

Particular preference is given to the construction in which at least one ring nozzle arrangement is provided on the upper shrinkage tunnel wall. This air guidance with an external downwardly directed hot air curtain is particularly advantageous. However, it is also possible, partly also dependently on the shape of the articles and the points at which increased shrinkage is to occur, to replace this arrangement or in addition thereto, to provide corresponding ring nozzles, preferably in the form of the above-described hot air units at other points. Thus, for example, for mainly vertically standing articles, for example bottles arranged one behind the other in rows, it is possible to have an arrangement with two facing lateral ring nozzles, whereas in the case of preferred shrinkage in the lower area, one ring nozzle would be positioned below the air-permeable conveyor. Although it is normally sufficient as a result of the effectiveness of the air guidance to provide only one ring nozzle unit along the length of the shrinkage tunnel, for special applications, it would also be possible to successively arrange several ring nozzle units.

If preferably the inner casing part cooperates with its inner edge bounding the return flow opening and linked with the toroidal stamping with a circular rim of the fan wheel accompanied by the formation of a gap linked with that part of the exhaust conduit positioned inside the stamping, then a return flow forms within the conduit which increases the efficiency of the fan due to the favourable configuration of the fan casing, no additional measures are required for this.

It must also be recognized that with the heating means arranged directly on the outer circumference of the fan blades ideal heat transfer conditions are obtained and consequently despite the high relative heating surface loading, it is possible to operate with low surface temperatures. Due to their construction as a meander-like arc or circle, the heating means are positioned in the form of a grating in front of the radial fan wheel outlet and there is a transverse flow against the same in order to achieve optimum heat transfer.

Features of preferred further developments of the invention can be gathered from the subclaims and description in conjunction with the drawings, the individual features being possibly essential for the invention either singly or in various combinations.

An embodiment of the invention is described hereinafter relative to the drawings, wherein show:

FIG. 1—a cross-section through a shrinkage tunnel.

Figure 2:
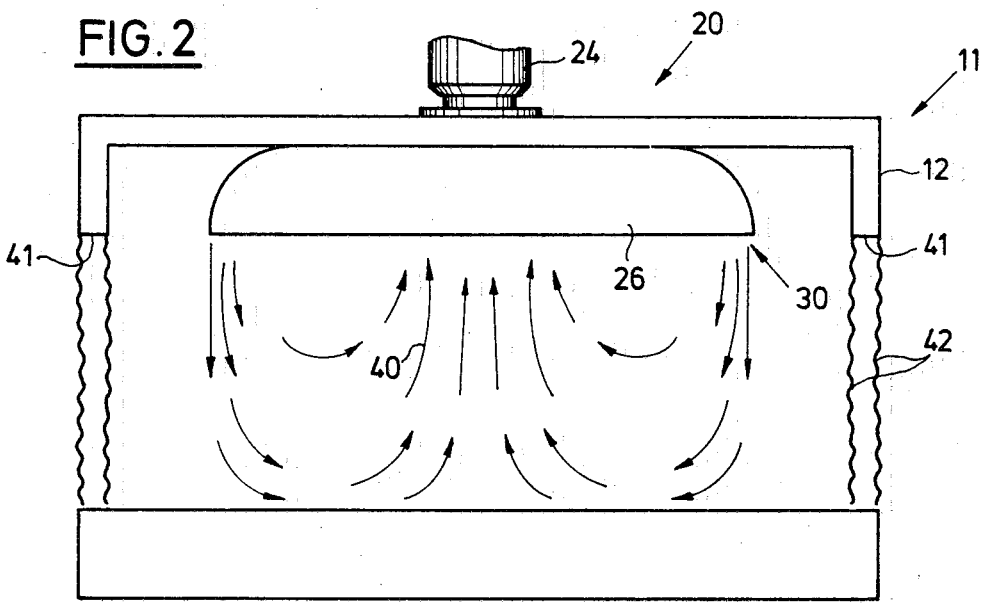

FIG. 2—a diagrammatic longitudinal section through the shrinkage tunnel.

The represented shrinkage tunnel 11 used for the heat treatment of a shrinkable film, i.e. a prestretched film which, as a result of heat treatment, shrinks to a greater extent and passes closely around not shown articles which are to be packaged. The shrinkage tunnel 11 has a rectangular casing in the form of a box with inlets and outlets 41, which are closed by flexible curtains 42. The articles are conveyed by a conveyor 17, which can e.g. comprise rods guided on either side on revolving chains, through the shrinkage tunnel inner area 16. Shrinkage tunnel casing 12 comprises an outer casing 13, and an inner casing 14 with interposed insulation 15, which envelops the complete tunnel, with the exception of an area on the top 19 of the casing to be described hereinafter.

Within the tunnel inner area 16, a hot air flow is maintained by a hot air unit 20 having a fan 21, which contains the fan wheel 22 of a radial fan having a lower central suction port and radial blades 23 arranged on the outer circumference. The vertical fan shaft 25 is driven by a fan motor 24. Motor 24 is mounted on a base plate 38, which is connected by means of stay bolts 39 to the outer casing part 27 of fan casing 26. Insulation 15 is placed between the base plate and the outer casing part 27, which is in the form of an inverted, sheet metal dish or shell. In the latter is arranged an inner casing part 28, which is also made from shaped sheet metal and has a somewhat shallower dish shape, and is centrally provided with a downwardly curved flange or bead 31, whose inner edge defines a central return flow opening 32. Thus, this casing part is shaped like a rotating body, whose cross-sectional surface is approximately S-shaped. The two casing parts 27, 28 are also joined together by means of stay bolts 37 and receive therein the fan wheel 22 in such a way that the space enclosed between them forms the exhaust conduit 35 of the fan. This conduit contains heating means 36, which comprise electrical tubular heaters, which are bent in the form of a wavy band, which is in turn bent into an arcuate or spiral sectional shape, so that it is arranged around the circumference of the fan wheel and the air leaving the latter flows directly and transversely against it. The exhaust conduit 35, which is relatively wide in this area, tapers, whilst following the circular dish shape of the two casing parts, to a ring nozzle 30, whose annular outlet vertically directs the flow. The flow duct between exhaust conduit 35 and the ring nozzle is consequently shaped like a nozzle, which simultaneously tapers and is deflected by 90° and passes in an annular manner around the entire fan casing.

As is indicated by the flow arrows 40, this leads to an air flow passing vertically downwards from ring nozzle 30 in the form of a closed, cylindrical air curtain, which then reverses its direction and moves upwards in the centre, then directly enters the fan wheel again through the return flow opening 32, which simultaneously forms the suction port for the fan. The flanges 31 form a flow-favourable inlet cross-section. The flange inner edge 45 engages in an axially directed edge of the lower connecting ring of the fan blades 23, so that a gap 45 forms between them through which there is a flow return suction from the flange inner area 33 into the fan wheel as a result of the fan gap. Due to the almost toroidal configuration of this flange inner area 33, there is a flow which improves the fan efficiency.

Fan casing 26 takes up most of one tunnel inner wall, namely the upper wall 19. In the transverse direction, it extends almost to the side walls 18, whilst it is not too far from the inlets and outlets 41 in the longitudinal direction. Thus, the ring wall embraces a considerable part of a tunnel wall surface, so that in the represented embodiment complete tunnel inner area 16 is covered by its flow. Even when a plurality of ring nozzles are provided, they are arranged in such a way that they essentially maintain their own flow path in the sense of an almost closed system, i.e. with each ring nozzle is associated its own return flow opening. Advantageously, there is only a relatively small air exchange between the flow systems of the individual hot air units and this would also make it possible to optionally set different speeds and/or temperatures in the case of several hot air units being provided in the same shrinkage tunne. Control can take place very easily by means of the speed of motor 24 and/or there can be a stepwise, infinitely variable or timing control of the electrical heating system, for which purpose thermostats can be provided in the exhaust conduit.

The complete fan 21 with motor and fan wheel, fan casing 26 and base plate 38, including insulation, forms a functional, preassemblable standard unit which can be inserted from below through a cutout 46 provided in the upper tunnel wall 19, because base plate 38 is screwed to the projecting outer wall portion 47. The base plate with the interposed insulation and the outer fan casing part forms a circular portion of the insulated outer wall, which is only interrupted by the guidance tube for the fan shaft 25. Thus, the complete shrinkage tunnel can be insulated in double-walled manner. In a not represented manner, normally the upper casing part of the shrinkage tunnel can be removed, so as to permit maintainance on the conveying means.

What is claimed is:

1. An apparatus for shrinking a film envelope onto piece goods by application of hot air, comprising: a hot air current assembly disposed inside a shrinking chamber defined by chamber walls, the hot air current assembly having a fan casing directing hot air in a current circulation path out of a circumferentially arranged outlet of an annular shape formed by the casing, and back into a central inlet of said casing, the hot air current assembly further comprising a fan rotor member associated with and connected to a drive motor for driving the hot air in the current circulation path, an air heating means and a support member, the support member being a base plate inserted as a wall part into an opening of one of the chamber walls, and wherein the entire hot air current assembly is mounted inside the shrinking chamber by fixing the base plate to said one of the chamber walls.

2. An apparatus according to claim 1, wherein the outlet is at least one ring nozzle of a large outlet cross-section formed by an end of an undivided annular exhaust conduit of the fan casing.

3. An apparatus according to claim 1, wherein the annular outlet of the hot air current assembly extends substantially across a width of the shrinking chamber and extends close to the inside of side chamber walls of the shrinking chamber.

4. An apparatus according to claim 1, wherein the inlets of the hot air assembly are arranged centrally in said circumferentially-arranged outlet of an annular shape.

5. An apparatus according to claim 1, wherein the outlet of the hot air current assembly is provided on an outer annular circumference of an exhaust conduit, the fan rotor member being a radially exhausting fan rotor arranged coaxially with the outlet of the hot air current assembly and wherein the inlet of the hot air current assembly is connected to the shrinking chamber and formed by a suction port of the fan rotor member.

6. An apparatus according to claim 1, wherein the heating means is formed by an electrical tubular heating member arranged in an exhaust conduit and comprising arcuate portions arranged in an annular shape around the fan rotor member.

7. An apparatus according to claim 6, wherein the arcuate portions are spirals.

8. An apparatus according to claim 1, wherein the drive motor is arranged on an outside of the base plate outside the shrinking chamber, the drive motor forming a preassembled unit with the hot air current assembly.

9. An apparatus according to claim 1, wherein the casing of the hot air assembly defining the outlet comprises nested inner and outer, shell-shaped sheet metal casing parts, the inner casing part forming a nozzle-like inlet opening.

10. A shrinkage tunnel according to claim 1, wherein at least one outlet of the hot air current assembly is provided associated to an upper chamber wall of the shrinking chamber and directed downwards.

11. An apparatus for shrinking a film envelope onto piece goods by application of hot air, comprising:

a hot air current assembly disposed inside a shrinking chamber defined by chamber walls, the hot air current assembly having a fan casing directing hot air in a current circulation path out of a circumferentially arranged outlet formed by the casing, and back into a central inlet of said casing, the hot air current assembly further comprising a fan rotor member associated with and connected to a drive motor for driving the hot air in the current circulation path, an air heating means and a support member, the support member being a base plate inserted as a wall part into an opening of one of the chamber walls, the entire hot air current assembly being mounted inside the shrinking chamber by fixing the base plate to said one of the chamber walls, and wherein an exhaust conduit of the hot air assembly is tapered in cross-section from an end associated with the fan motor member to the outlet, simultaneously arranged in an annular shape all around the casing of the hot air current assembly.

12. An apparatus for shrinking a film envelope onto piece goods by application of hot air, comprising:

a hot air current assembly disposed inside a shrinking chamber defined by chamber walls, the hot air current assembly having a fan casing directing hot air in a current circulation path out of a circumferentially-arranged outlet formed by the casing, and back into a central inlet of said casing, the hot air current assembly further comprising a fan rotor member associated with and connected to a drive motor for driving the hot air in the current circulation path, an air heating means and a support member, the support member being a base plate inserted as a wall part into an opening of one of the chamber walls, the entire hot air current assembly being mounted inside the shrinking chamber by fixing the base plate to said one of the chamber walls, and wherein the inner casing part at an inner edge bounding the central inlet comprises a circular flange-like stamping, said stamping meshing with a circular edge of the fan rotor member, thereby forming a gap air current connected with a part of an exhaust conduit positioned within the stamping.

* * * * *